US006375339B2

(12) United States Patent
Maruyama et al.

(10) Patent No.: US 6,375,339 B2
(45) Date of Patent: Apr. 23, 2002

(54) LIGHTING APPARATUS

(75) Inventors: Kaname Maruyama; Takashi Honda; Shuichi Taniguchi; Masahiko Hori, all of Yoshida-machi (JP)

(73) Assignee: Twinbird Corporation, Niigata-ken (JP)

( * ) Notice: Subject to any disclaimer, the term of this patent is extended or adjusted under 35 U.S.C. 154(b) by 0 days.

(21) Appl. No.: 09/678,360

(22) Filed: Oct. 3, 2000

(30) Foreign Application Priority Data

Jun. 8, 2000 (JP) ..... 2000-177182

(51) Int. Cl.[7] ..... F21V 21/08
(52) U.S. Cl. ..... 362/287; 362/418
(58) Field of Search ..... 362/353, 351, 362/343, 287, 419, 410, 414, 285, 418

(56) References Cited

U.S. PATENT DOCUMENTS 6,168,292 B1 * 1/2001 Sherman ..... 362/287

FOREIGN PATENT DOCUMENTS

JP 6-50130 7/1994

JP 7-51691 11/1995

* cited by examiner

*Primary Examiner*—Sandra O'Shea
*Assistant Examiner*—Bao Truong
(74) *Attorney, Agent, or Firm*—Quarles & Brady LLP

(57) ABSTRACT

A lighting apparatus which enables a shade to be easily attached, detached and rotated with a simple structure and an enhanced degree of freedom in design. Grooves 9,10 defining arc-shaped portions 15,16, respectively, are formed around an axis of a head 4, to which is mounted a fluorescent light bulb 7. A shade 8 which is formed with protrusions 17, 18 opposite to the grooves 9, 10 is mounted to the head 4 so as to cover the fluorescent light bulb 7. By pressing the protrusions 17, 18 of the shade 8 into the grooves 9, 10 of the head 4, the shade 8 can be very easily mounted to the head 4. By lifting up the shade 8 from the head 4, the shade 8 can be very easily removed from the head 4. In addition, the shade 8 can be rotated by allowing the protrusions 17, 18 formed on the shade 8 to slide along the arc-shaped portions 15, 16. As such shade 8 allows a simple integral structure, degree of freedom in designing a lighting apparatus can be enhanced.

5 Claims, 6 Drawing Sheets

LIGHTING APPARATUS

BACKGROUND OF THE INVENTION a) Field of the Invention

The present invention relates to a lighting apparatus, particularly to a mounting structure of a shade for use with an electric table lamp.

b) Prior Art

Conventional lighting apparatus, particularly a conventional electric table lamp, is disclosed for example in Japanese Utility Model Un-Examined Publication No.6-50130 and Japanese Utility Model Examined Publication No.7-51691. The Publication No. 6-50130 discloses an electric lamp which comprises: a shade; an arm; and a lamp mounted to the shade, said shade having one end rotatably mounted to an upper end of said arm through a rotating mechanism. In this prior art, a socket and the lamp are attached to the shade, thus enabling the adjustment of the lighting direction by the rotation of the shade. The latter prior art or the Publication No. 7-51691 discloses another table lamp which comprises: an arm; an attachment plate mounted to the arm; a straight-tube-type lamp; and a socket provided on the attachment plate for retaining the lamp; and a cylindrical shade surrounding both the attachment plate and the lamp, wherein a fastening cover is mounted to said attachment plate, so that the shade can be locked in a manner capable of rotating around an axis of the lamp. In this prior art, the shade is independent of the socket and the lamp, so that the adjustment of the direction of light can be realized by rotating the shade only.

According to the structure disclosed by the former prior art, however, as the lighting tool which is rotatable relative to the arm consisted of the shade, the socket and the lamp, the tool was so heavy that it required other mechanisms such as a tightening mechanism or a stopper mechanism for tightening or making the rotating mechanism stationary, and thus, the structure became too complicated. Besides, to move the shade which was once made stationary, it was necessary to relax the tightening mechanism or to release the stopper mechanism, thereby resulting in a nuisance in handling the apparatus. Furthermore, as the socket and the lamp were mounted to the shade, there was resulted a certain constraint in designing the shade. According to the structure of the latter prior art, whilst the weight of the movable part became smaller, it was necessary to attach the shade, using the fastening cover which is separate from the shade, so that not only the attaching and detaching works of the shade were a nuisance, but also the increased costs were resulted.

SUMMARY OF THE INVENTION

To eliminate the above problems, it is a main object of the invention to provide a lighting apparatus which realizes an easier attachment and detachment as well as an easier rotation of the shade with a simple and less expensive structure.

It is another object of the invention to provide a lighting apparatus with an enhanced degree of freedom in designing the same.

To attain the above objects, there is provided from a first aspect of the invention, a lighting apparatus which comprises: a head having a socket; an electric light bulb mounted to the socket of the head; and a shade for covering the electric light bulb, wherein one of the head and the shade is formed with a protrusion, while the other thereof is formed with a groove which is opposite to the protrusion, whereby the shade is mounted to the head by allowing the protrusion to engage with the opposite groove.

According to the first aspect of the invention, the shade can be easily mounted to the head through the engagement of the former to the latter by fitting the protrusions formed on the shade or the head into the grooves formed on the head or the shade.

Further, there is provided from a second aspect of the invention, a lighting apparatus with the structure of the first aspect, wherein one of the groove and the protrusion is formed around an axis of said head so that at least a part thereof may construct an arc-shaped portion such that the protrusion or the groove opposite thereto may be slidable relative to the arc-shaped portion, whereby said shade is mounted to the head in a manner capable of rotating around the axis of said head.

According to the second aspect of the invention, when a user rotates the shade around the axis of the head, the protrusions or grooves formed on the shade are slidable within the arc-shaped portions along the grooves or protrusions formed on the head, so that the shade is easily rotated around the axis, thereby easily adjusting the direction of light.

In addition, according to a third aspect of the invention, there is provided a lighting apparatus with the structure of foregoing aspects, wherein said head and shade are each formed with at least one pair of the protrusions or the grooves. Thus, the shade can be fixedly mounted to the head without wobbling.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which:

FIG. 2*a* and FIG. 2*b* are partially enlarged views of the lighting apparatus of FIG. 1, in which FIG. 2*a* shows the enlarged section of the shade, while FIG. 2*b* a head of the lighting apparatus.

FIG. 3*a* and 3*b* are sections of a principal part of the lighting apparatus of FIG. 1, taken along its A—A line, in which FIG. 3*a* illustrates the shade in a horizontal state, while FIG. 3*b* the shade which has been rotated.

FIG. 5*a* and FIG. 5*b* are partially enlarged views of the lighting apparatus of FIG. 4, in which FIG. 5*a* shows the enlarged section of the shade, while FIG. 5*b* a head of the lighting apparatus.

FIG. 6*a* and 6*b* are sections of a principal part of the lighting apparatus of FIG. 4, taken along its B—B line, in which FIG. 6*a* illustrates the shade in a horizontal state, while FIG. 6*b* the shade which has been rotated.

DESCRIPTION OF PREFERRED EMBODIMENTS

Figure 1:
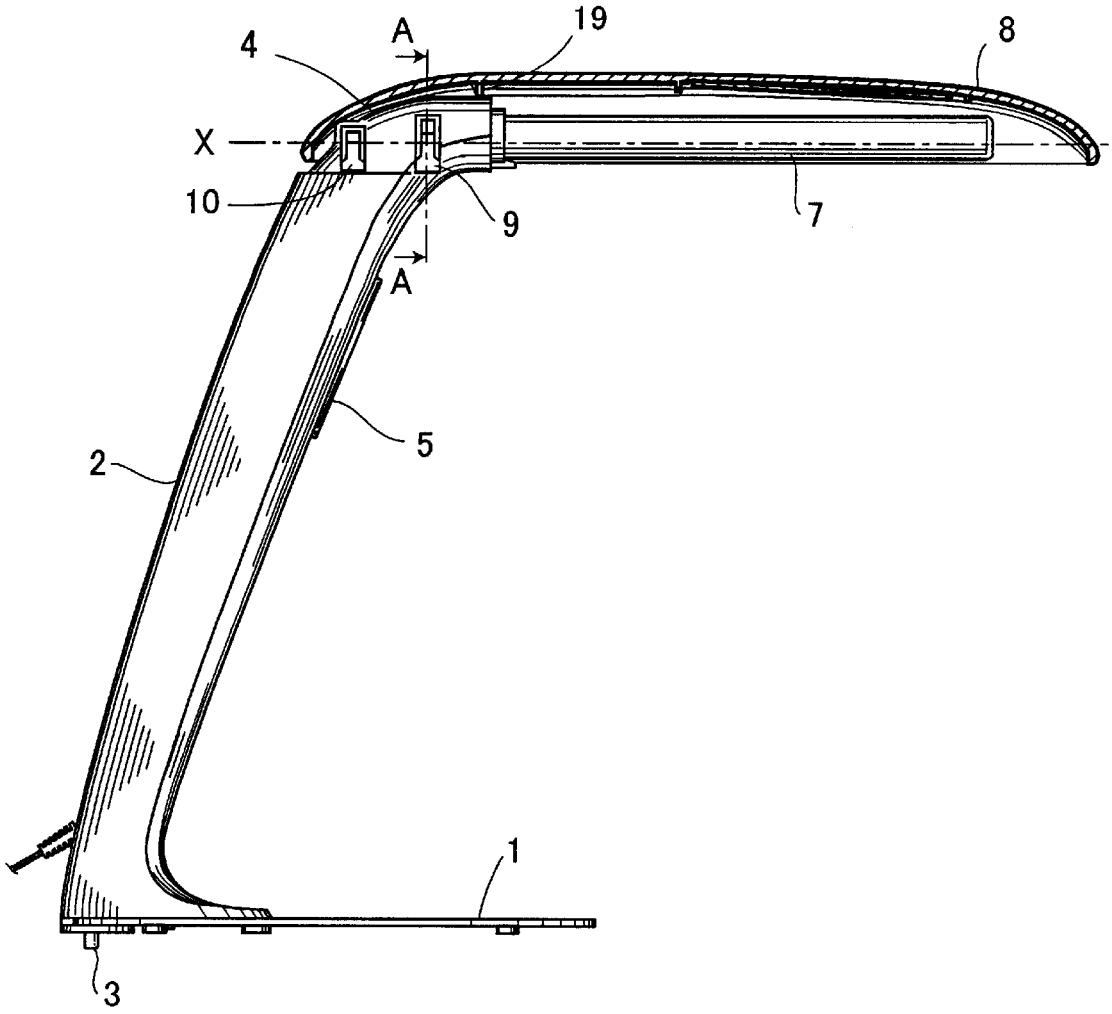
FIG. 1 is a schematic front view of a lighting apparatus according to an embodiment of the invention in which a part of a shade is cut away for explanation purpose.
Figure 2A:
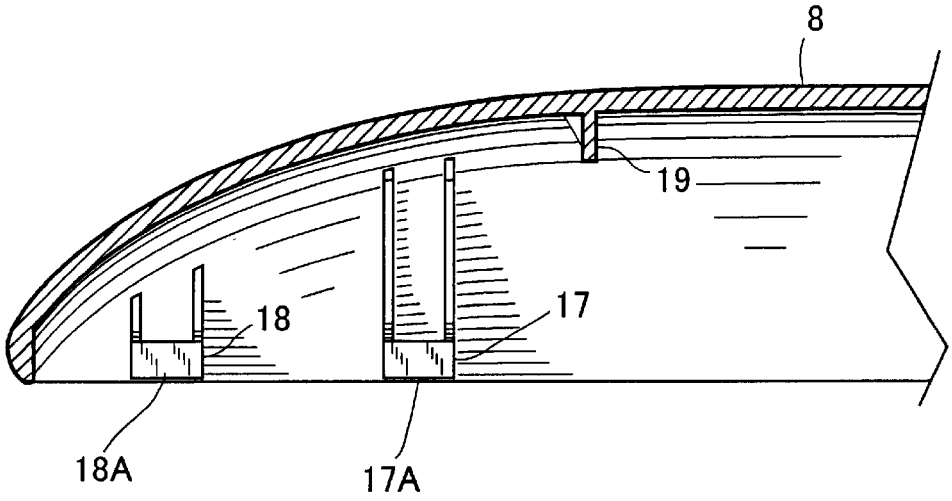
Figure 2B:
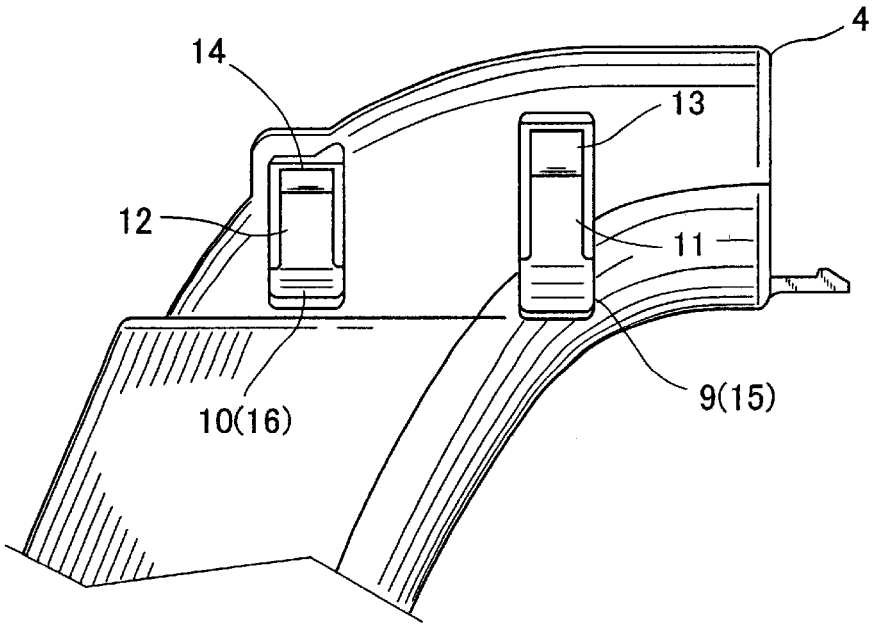

Hereinafter are described preferred embodiments of the present invention with reference to FIGS. 1 through 3.

Reference numeral 1 designates a metallic plate-like base, said base 1 having an end to which is mounted a post 2. Below the post 2 is provided a safety switch 3 protruding downwardly of the base 1, while above the post 2 is integrally provided a head 4. The post 2 comprises a lighting switch 5. The head 4 is provided by bending an upper portion of the post 2 so that it extends along a virtual horizontal axis X, having a socket 6 for connecting a fluorescent light bulb on its end. The fluorescent light bulb 7 is removably mounted to the socket 6 of the head 4 in a manner that the longitudinal direction of the fluorescent light bulb 7 may coincide with that of the head 4. A shade 8 is removably mounted so as to cover the head 4 and the fluorescent light bulb 7.

An external surface of the head 4 is formed with concavities or grooves 9 and 10 provided around the virtual axis X. The grooves 9, 10 are formed with flexible engagement portions 11, 12, respectively, each having portions cut away corresponding to the upper and lateral ends of the grooves 9, 10. The flexible engagement portions 11, 12 are formed with stopper projections 13, 14 adjacent the respective distal ends, while the flexible engagement portions 11, 12 are formed elastically deformable inwardly toward the head 4. Thus, from the respective lower ends of the grooves 9, 10 to the stopper projections 13, 14 extend arc-shaped portions 15, 16 the center of which is on the aforesaid virtual axis X.

An inside of the proximal end of the shade 8 is formed with protrusions 17, 18, corresponding to the grooves 9, 10, respectively. Each protrusion 17 has an inner end face 17A so that a distance between the opposite inner end faces 17A may be smaller than the maximum distance between the opposite arc-shaped portions 15 and the maximum distance between the opposite stopper projections 13, respectively. Likewise, each protrusion 18 has an inner end face 18A so that a distance between the opposite inner end faces 18A may be smaller than the maximum distance between the opposite arc-shaped portions 16 and the maximum distance between the opposite stopper projections 14, respectively.

The protrusions 17, 18 have respective lower ends positioned below the virtual axis X when the shade 8 is mounted to the head 4. In other words, the opposite protrusions 17, 18 are each spaced apart from the respective counterpart at an angle of 180 degrees or above, while the lower ends thereof protrude inwardly so that the inner end faces 17A,18A may extend nearly along the arc-shaped portions 15, 16, respectively. Incidentally, reference numeral 19 designates a lug which contacts a top surface of the head 4 to thereby position the shade 8.

The aforesaid grooves 9, 10 as well as the protrusions 17, 18 are disposed around the virtual axis X of the head 4, which means that when the shade 8 is mounted to the head 4, the protrusions 17, 18 formed in the shade 8 is allowed to slide along the grooves 9, 10 in a direction rotating around the virtual axis X. This, however, does not necessarily mean that the grooves 9, 10 and the protrusions 17, 18 are longer in the rotating direction around the virtual axis X than in the direction toward the axis X.

Next, the action of a lighting apparatus according to the foregoing embodiment is described.

Initially, the fluorescent light bulb 7 is attached to the socket 6 on the head 4 so that the fluorescent light bulb 7 is supported by the socket 6 only. Then, the shade 8 is mounted from above to the head 4 to allow the protrusions 17, 18 to be inserted into the grooves 9, 10 of the head 4, respectively.

Although each protrusion 17 has the inner end face 17A such that the distance between the opposite inner end faces 17A may be smaller than the maximum distance between the opposite arc-shaped portions 15 and the maximum distance between the opposite stopper projections 13, respectively, and likewise, each protrusion 18 has the inner end face 18A such that the distance between the opposite inner end faces 18A may be smaller than the maximum distance between the opposite arc-shaped portions 16 and the maximum distance between the opposite stopper projections 14, respectively, it should be noted that the aforesaid stopper projections 13, 14 as well as the arc-shaped portions 15, 16 are provided on the flexible engagement portions 11, 12. Accordingly, when mounting the shade 8 to the head 4, the stopper protrusions 13, 14 are pressed by the protrusions 17, 18 so that they are elastically deformed, thereby allowing the protrusions 17, 18 to fit into the arc-shaped portions 15, 16 of the grooves 9, 10, respectively. Consequently, the protrusions 17, 18 will not be off the grooves 17, 18 as long as they are fitted in the arc-shaped portions 15, 16 of the grooves 9, 10.

Further, as the lug 19 contacts the top surface of the head 4, the shade 8 is able to be properly positioned so that the shade 8 is kept a certain distance away from the head 4, while being prevented from going too downwardly, thereby keeping the inner end faces 17A. 18A of the protrusions 17, 18 in close contact with the arc-shaped portions 15, 16, respectively. This way, two pairs of the protrusions, i.e., a pair of the protrusions 17 of the shade 8 and another pair of the protrusions 18 thereof, are retained inside the two pairs of the grooves, i.e., a pair of the grooves 9 of the head and another pair of the grooves 10 thereof, respectively, whereby the shade 8 is able to be prevented from becoming wobbly relative to the head 4, so that it can be steadily mounted thereto.

Figure 3A:
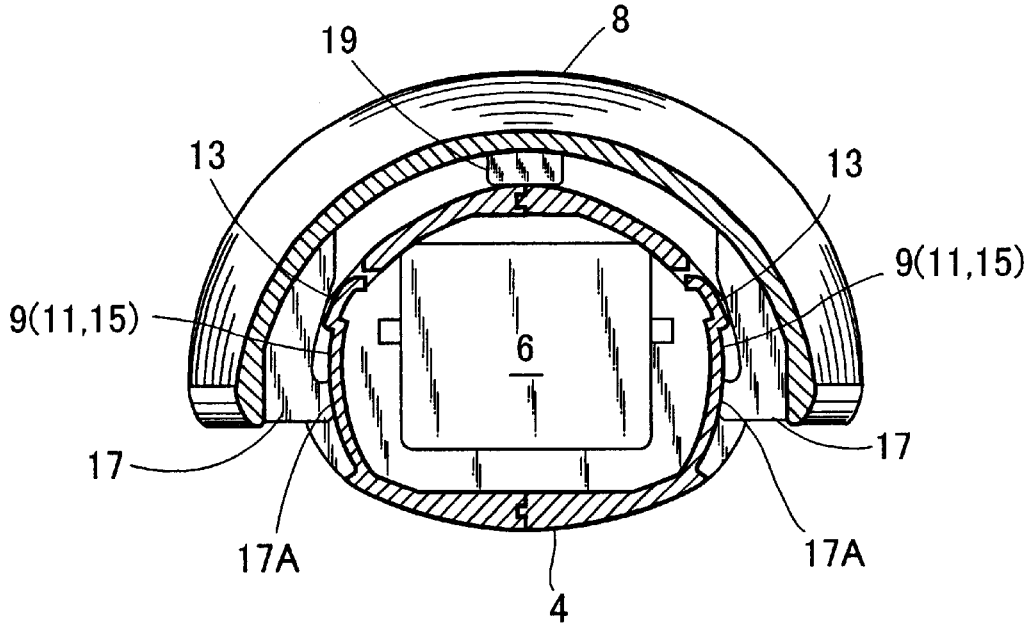
Figure 3B:
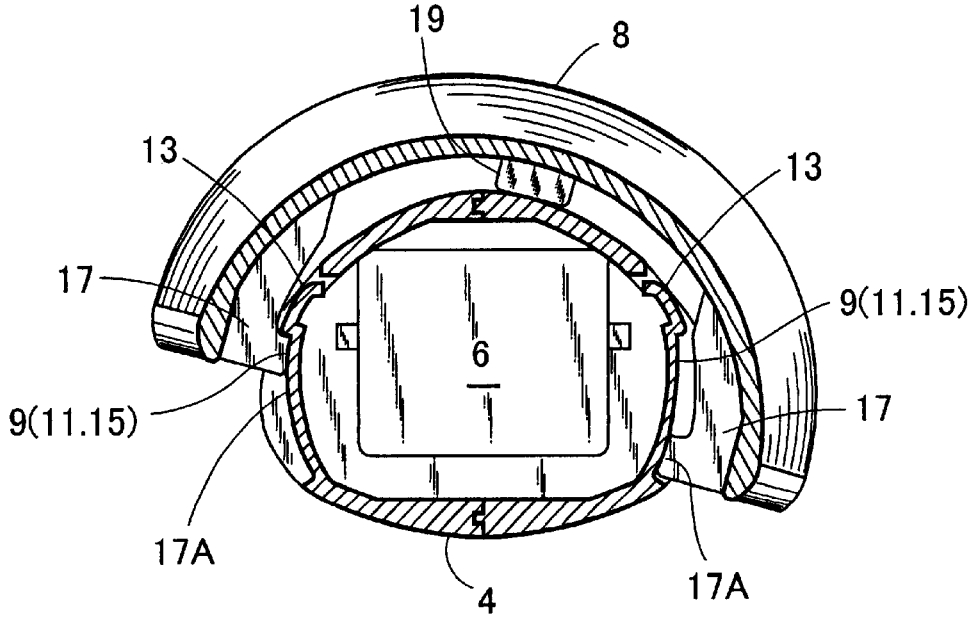

In such a state as above described, the shade 8 is able to be rotated around the virtual axis X within a predetermined range of angle. In other words, when the shade 8 is rotated around the virtual axis X, the inner end surface 17A of the protrusion 17 is allowed to slide along the arc-shaped portion 15, as illustrated in FIG. 3*a* and FIG. 3*b*. At that time, if the arc-shaped portion 15 involves some error in circularity, yet such error will be absorbed by the deflection of the flexible engagement portion 11. Thus, if the shade 8 is rotated by a predetermined angle relative to the head 4, such rotation will be regulated either by the top end of one of the protrusions 17 abutting onto the stopper projection 13, or by the lower end of the other of the protrusions 17 abutting onto the lower end of the arc-shaped portion 15. It should be noted that the same mechanism applies to the relationship between the groove 10 and the protrusion 18, and thus the explanation of the mechanism will be omitted. By rotating the shade 8 in the foregoing manner, light from the fluorescent light bulb 7 can be directed to an arbitrary direction, within a rotatable range of the shade 8.

When removing the shade 8, the shade 8 is lifted up with the same being held horizontally. At that moment, whilst the inner end surface 17A of the protrusion 17 abuts onto the arc-shaped portion 15 and the stopper projection 13, the arc-shaped portion 15 and the stopper projection 13 are disposed on the flexible engagement portion 11, and thus they are elastically deformed, thereby enabling the protrusion 17 to be removed from the groove 9. As the same mechanism applies to the relationship between the groove 10 and the protrusion 18, the explanation thereof will be omitted.

Figure 4:
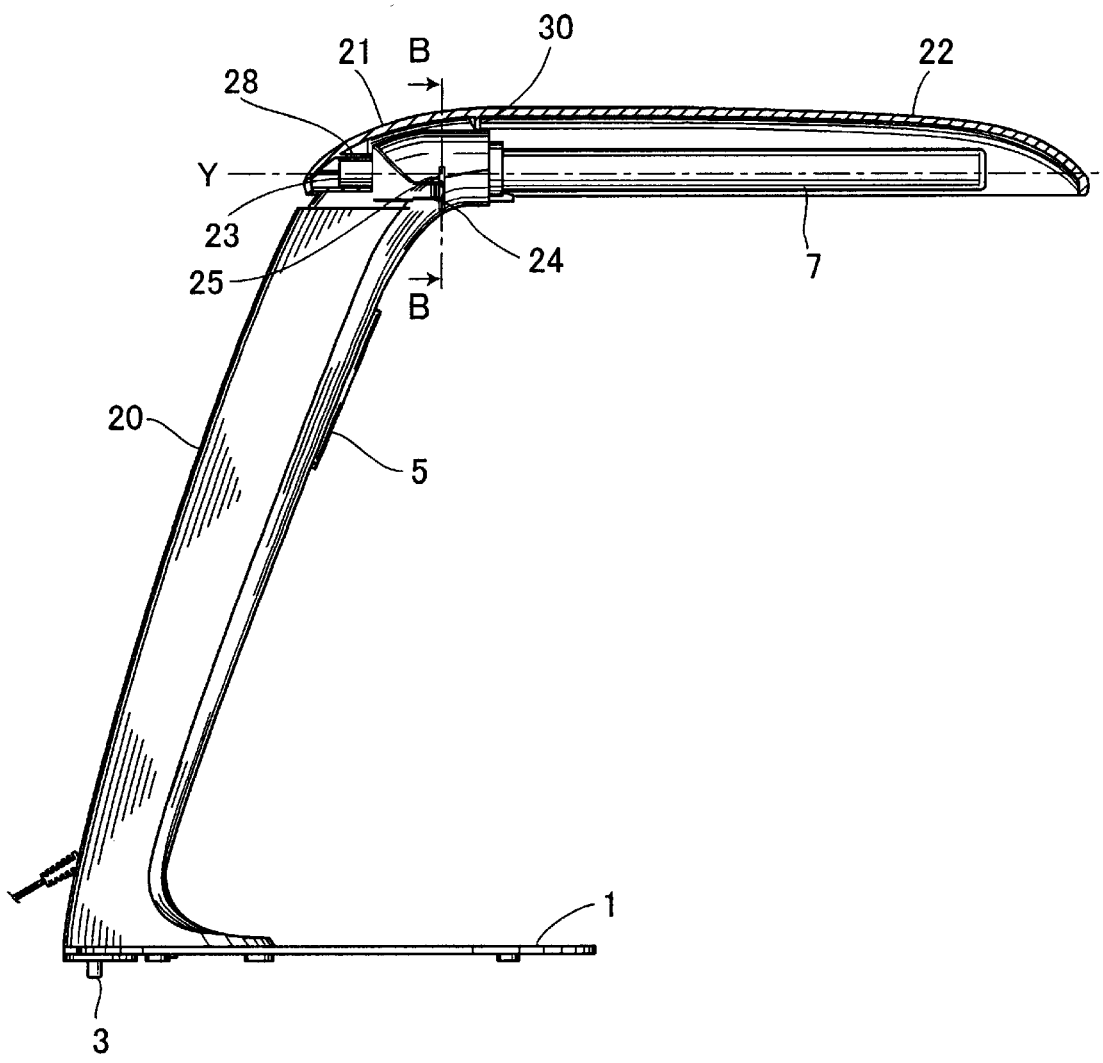
FIG. 4 is another schematic front view of a lighting apparatus according to another embodiment of the invention, in which a part of a shade is cut away for explanation purpose.
Figure 5A:
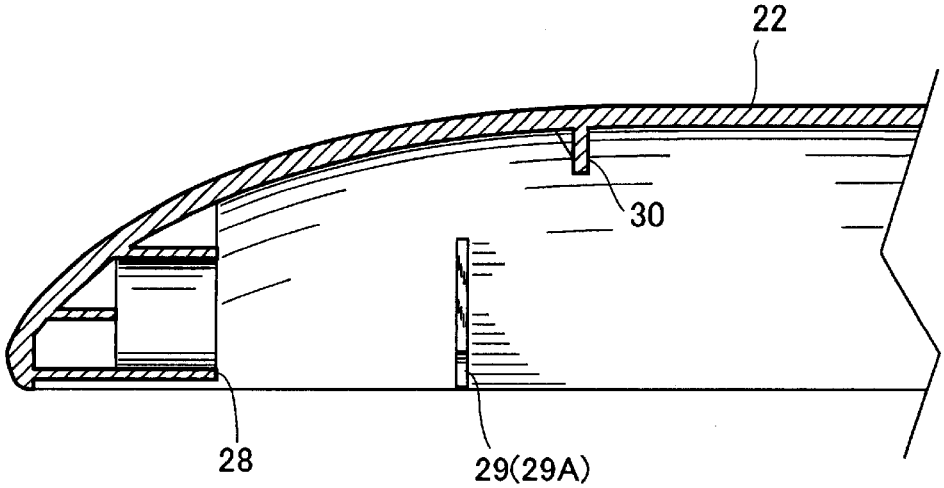
Figure 5B:
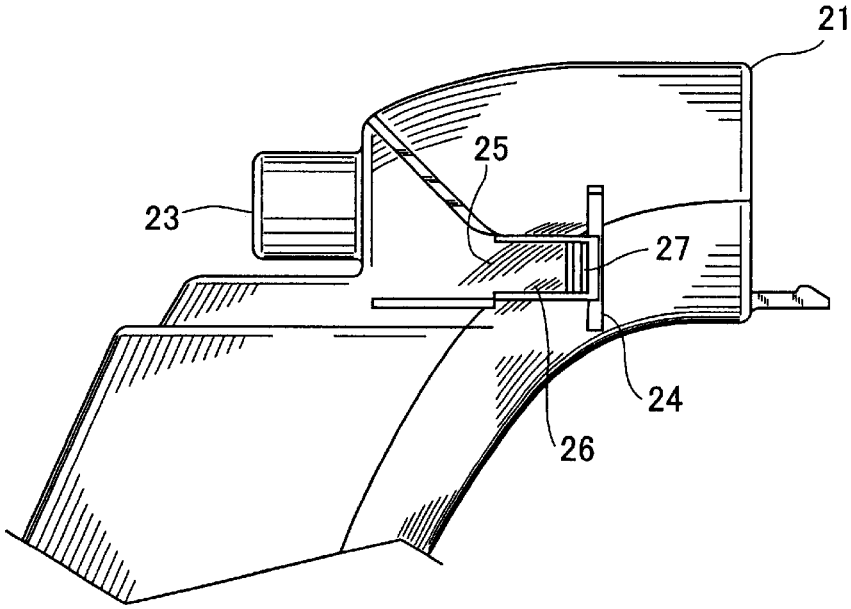

Next, another embodiment of the invention will be described with reference to FIGS. 4 through 6, in which the same portions as those described in the foregoing embodiment will be designated by the same reference numerals, and their repeated detailed descriptions will be omitted.

In this embodiment, a top of a post 20 is integrally formed with a head 21, said head 21 being provided by bending the top of the post 20 so that it is elongated toward the horizontal direction defined by a hereinafter-described axis Y, while the socket 6 for connecting the fluorescent light bulb thereto is provided at an end. The fluorescent light bulb 7 is removably mounted to the socket 6. A shade 22 is also removably mounted, covering the head 21 and the fluorescent light bulb 7.

A proximal end of the head 21 is formed with a cylindrical axial portion 23 of which the center is on the axis Y. An outside surface of the head 21 is formed with a groove 24 disposed around the axis Y, to which is perpendicularly formed a leading groove 25 extending toward the direction defined by the axis Y. A bottom surface of the groove 24 is arc-shaped from its top end to its lower end with the center of the arc being on the axis Y. The said leading groove 25 is provided with a flexible engagement portion 26 which is cut away where it communicates with the groove 24 and also where it corresponds to the upper and lower ends of the said groove 25, respectively, while the flexible engagement portion 26 is formed with a stopper projection 27 at an end adjacent the groove 24, so that the flexible engagement portion 26 may be elastically deformable inwardly toward the head 21.

On the other hand, an inside of the proximal end of the shade 22 is formed with a bearing 28 which is cylinder-shaped, corresponding to the aforesaid axial portion 23, as well as a pair of protrusions 29, each of which is rib-shaped, corresponding to the aforesaid groove 24. The bearing 28 is so structured that it may cover the axial portion 23, while a pair of the protrusions 29 defines a distance therebetween which is smaller than the maximum distance between the two grooves 24, and the maximum distance between the two stopper projections 27, respectively. Further, when mounting the shade 22 to the head 21, the protrusion 29 allows its lower end to be positioned downwardly of the axis Y. In other words, the aforesaid pair of the protrusions 29 is spaced apart from each other at an angular interval of 180 degrees or above, with respect to the axis Y as the center of rotation, while each protrusion 29 allows a lower end thereof to protrude inwardly so that an inner end edge 29A extends nearly along the groove 24. Reference numeral 30 designates a lug which abuts onto the top surface of the head 21 to thereby properly position the shade 22. In the meantime, the relationship between the axial portion and the bearing may be inverted. In other words, the bearing may be provided on the head 21, while the axial portion on the shade 22.

Next, the action of a lighting apparatus according to the above embodiment of the invention will be described.

Initially, the fluorescent light bulb 7 is attached to the socket 6 provided on the head 21. Then, the shade 22 is mounted from the proximal side of the head 21 along the direction defined by the axis Y so that the bearing 28 may cover the axial portion 23 and the protrusions 29 may be inserted into the leading grooves 25, respectively.

When mounting the shade 22 by pressing the same toward the distal end of the head 21 along the axis Y, the distance between the pair of the inner end edges 29A of the protrusions 29 is smaller than the maximum distance between the pair of the stopper projections 27, and thus the protrusions 29 are allowed to abut to the stopper projections 27, respectively. Whereas, the stopper projections 27 are provided on the flexible engagement portions 26 adjacent to the ends of the grooves 24, the stopper projections 27 are pressingly pushed by the protrusions 29 so that they are elastically deformed, whereby the protrusions 29 are allowed to go beyond the stopper projections 27 to thereby get into the grooves 24. As long as the protrusions 29 are fitted into the grooves 24, the protrusions 29 will not come off therefrom. Further, as the lug 30 is allowed to abut onto the top surface of the head 21, the shade 22 is properly positioned, thereby keeping the space between the shade 22 and the head 21 constant, preventing the shade 22 from going too downwardly, while keeping the inner end edge 29A of the protrusion 29 in close contact with the groove 24.

Figure 6A:
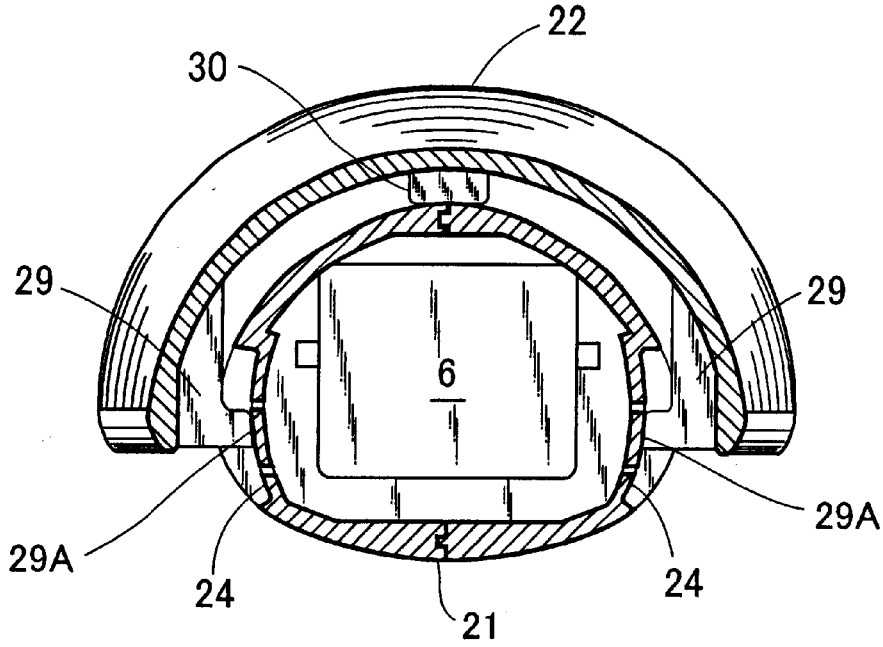
Figure 6B:
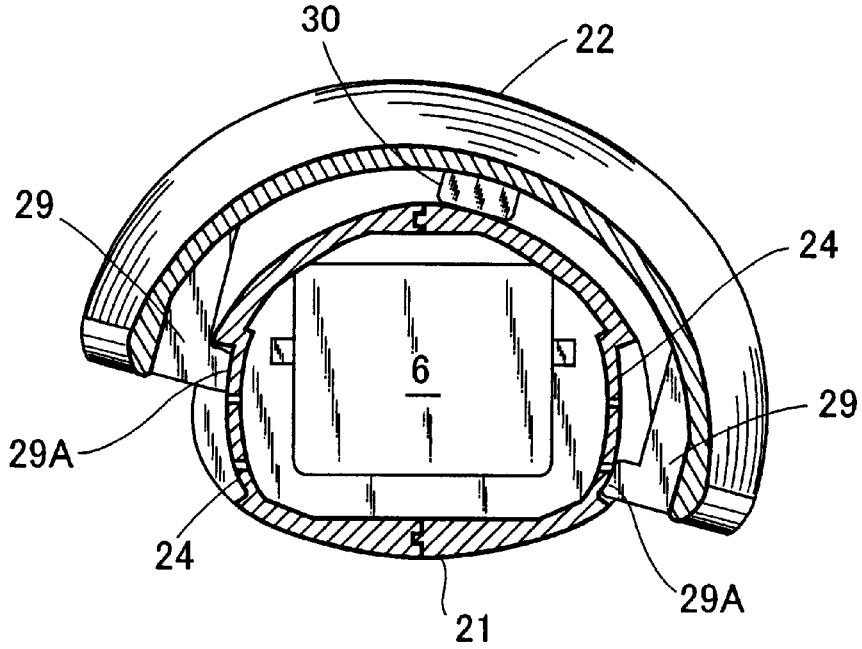

In such a state as described above, the shade 22 is capable of being rotated around the axis Y within a predetermined range of angle. Namely, when the shade 22 is rotated around the axis Y, as illustrated in FIGS. 6*a* and 6*b*, the bearing 28 is allowed to slide around the axial portion 23, while the inner end edge 29A of each protrusion 29 slides along the groove 24. When the shade 22 is rotated by a predetermined angle relative to the head 21, the upper end of one of the protrusions 29 is allowed to abut to the upper end of the groove 24, or otherwise, the lower end of the other of the protrusions 29 is allowed to abut to the lower end of the groove 24, whereby the rotation is regulated. By rotating the shade 22 this way, light from the fluorescent light bulb 7 is able to be directed to any direction you like, within a rotatable range of the shade 22.

When removing the shade 22, the shade 22 is pulled out toward the proximal end of the axis Y with the same being retained horizontally, thereby releasing the bearing 28 from the axial portion 23. Although the inner end edge 29A of each protrusion 29 abuts against each stopper projection 27 at that moment, the stopper projection 27 is formed at the end of the flexible engagement portion 26 adjacent to the groove 24, and thus it is pressed by the protrusion 29 to thereby be elastically deformed, whereby the protrusion 29 is allowed to go beyond the stopper projection 27 to get into the groove 25. By pulling out the shade 22 therefrom, the shade 22 is able to be removed from the head 21.

As is apparent from the foregoing, a lighting apparatus according to the present invention is structured such that the outside surface of the head 4 provided on the top of the post 2 is formed with the grooves 9, 10, said grooves 9, 10 extending around the axial direction of the head 4, whilst the fluorescent light bulb 7 is removably attached to the socket 6 of the head 4, said light 7 and head 4 being covered by the shade 8 which is removably mounted to the head 4, having the protrusions 17, 18 formed inside the proximal end thereof, corresponding to the grooves 9, 10, respectively.

With the structure thus made, the shade 8 is not only very easily able to be mounted to the head 4 by pressing the protrusions 17, 18 thereof into the grooves 9, 10 of the head 4, but also it is quite easily able to be removed therefrom simply by lifting the same from the head 4. Further, as the shade 8 can be formed, using a simple integral structure, the degree of freedom in designing the same is enhanced.

Additionally, as the grooves 9, 10 are formed around the axis of the head 4, and at least a part of each groove is formed as the arc-shaped portion 15 or 16 so that the protrusions 17, 18 formed on the shade 8 may slide along the arc-shaped portions 15, 16, the light from the fluorescent light bulb 7 is not only able to be directed to any arbitrary direction within a rotatable range of the shade 8, but also the structure for distribution of light can be simplified, as the shade 8 is the only movable member.

Incidentally, the present invention should not be limited to the foregoing embodiments, but may be modified within the scope of the invention. For example, although the grooves are formed on the head, and the protrusions are formed on the shade in the foregoing embodiments, the grooves may be formed on the shade, while the protrusions are formed on the head. Alternatively, both the grooves and the protrusions may be provided on the head, while the corresponding protrusions and grooves may be formed on the shade, respectively.

What is claimed is:

1. A lighting apparatus which comprises:

a head having a socket;

an electric light bulb mounted to the socket of the head; and a shade for covering the electric light bulb, wherein one of the head and the shade is formed with a protrusion, while the other thereof is formed with a groove which is opposite to the protrusion, whereby the shade is detachably mounted to the head by allowing the protrusion to engage with the opposite groove, wherein one of the groove and the protrusion is formed around an axis of said head so that at least a part thereof may construct an arc-shaped portion such that the protrusion or the groove opposite thereto may be slidable relative to the arc-shaped portion, said shade being mounted to the head in a manner capable of rotating around the axis of said head, and wherein the arc-shaped portion is formed with a flexible engagement portion so that an error in circularity may be absorbed by the deflection of the flexible engagement portion.

2. A lighting apparatus according to claim 1, wherein said head and shade are each formed with at least one of: a plurality of the protrusions or a plurality of the grooves.

3. A lighting apparatus according to claim 1, further comprising: a flexible engagement portion formed in the groove, said flexible engagement portion being partially cut away, corresponding to upper and lateral ends of the groove, having a stopper projection adjacent to a distal end thereof, whereby said arc-shaped portion is formed from a lower end of said groove to the stopper projection.

4. A lighting apparatus according to claim 1, further comprising a lug provided on an inside surface of said shade, said lug abutting onto a top surface of said head to thereby properly position the shade.

5. A lighting apparatus according to claim 1, wherein said protrusion allows a lower end thereof to be positioned downwardly of the axis of the head when the shade is mounted thereto.

* * * * *